US007540383B2

(12) United States Patent
Huffer et al.

(10) Patent No.: US 7,540,383 B2
(45) Date of Patent: Jun. 2, 2009

(54) SELF-OPENING BLISTER PACKAGE

(75) Inventors: Scott Huffer, Hartsville, SC (US); Michael Thornton, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 72 days.

(21) Appl. No.: 11/977,061

(22) Filed: Oct. 23, 2007

(65) Prior Publication Data

US 2009/0101537 A1 Apr. 23, 2009

(51) Int. Cl.
*B65D 83/04* (2006.01)

(52) U.S. Cl. ..... 206/530; 206/539; 206/804

(58) Field of Classification Search ..... 206/528, 206/530, 532, 534, 534.1, 534.2, 538, 539, 206/37, 205, 250, 254, 738, 739, 804, 816; 220/212, 255.1, 259.1, 359.1; 221/199, 226, 221/282, 287, 305, 306; 426/106, 115
See application file for complete search history.

(56) References Cited

U.S. PATENT DOCUMENTS

| | | | | | |
|---|---|---|---|---|---|
| 2,834,456 | A | * | 5/1958 | Langer | 206/532 |
| 2,917,162 | A | | 12/1959 | Horland | |
| 3,039,652 | A | | 6/1962 | Ekenstam et al. | |
| 3,743,086 | A | | 7/1973 | Aldrich | 206/52 R |
| 3,923,239 | A | * | 12/1975 | Lee | 206/804 |
| 4,444,310 | A | * | 4/1984 | Odell | 206/539 |
| 4,848,582 | A | * | 7/1989 | Levasseur et al. | 206/534.2 |
| 5,123,539 | A | | 6/1992 | De Vries et al. | 206/532 |
| 5,150,793 | A | | 9/1992 | Tannenbaum | 206/531 |
| 5,339,960 | A | | 8/1994 | Price | 206/531 |
| 5,727,687 | A | | 3/1998 | Renner | 206/532 |
| 5,878,887 | A | | 3/1999 | Parker et al. | 206/528 |
| 5,938,018 | A | | 8/1999 | Keaveney et al. | 206/261 |
| 5,944,191 | A | | 8/1999 | Ray et al. | 206/532 |
| 6,138,830 | A | | 10/2000 | Muggli | 206/532 |
| 6,155,454 | A | | 12/2000 | George et al. | 221/25 |
| 6,422,391 | B1 | | 7/2002 | Swartz | 206/531 |
| 6,929,004 | B1 | | 8/2005 | Bonney et al. | 128/203.15 |
| 6,997,320 | B1 | | 2/2006 | Kancsar et al. | 206/532 |
| 7,090,079 | B2 | * | 8/2006 | Ehrlund | 206/531 |
| 2004/0140242 | A1 | | 7/2004 | Davies | 206/538 |
| 2006/0042987 | A1 | | 3/2006 | Buss | 206/532 |

* cited by examiner

*Primary Examiner*—Luan K Bui
(74) *Attorney, Agent, or Firm*—DLA Piper LLP (US)

(57) ABSTRACT

A self-opening blister package is provided having a packaging sleeve or carton and a formed tray. The tray includes one or more receptacle cups, which are dimensioned to receive one or more products, such as gum or the like. A peelable membrane is sealed to the tray flange. A leading edge of the membrane is attached to the sleeve. The membrane peels away from the tray when the tray is removed from the sleeve. The peeling action exposes the product contained in the one or more cups. Once the desired amount of product is extracted, the tray can be pushed back into the sleeve and the membrane rolls back over the tray.

9 Claims, 2 Drawing Sheets

SELF-OPENING BLISTER PACKAGE

FIELD OF THE INVENTION

The present invention relates to a package for storing and dispensing individual products. More specifically, the invention contemplates a self-opening blister-type package.

BACKGROUND OF THE INVENTION

Blister packs are commonly used to package products including candy, gum, pharmaceutical tablets, swimming pool chemicals, gardening tablets, and the like. Such blister packs conventionally include a generally planar member of plastic material. This planar member includes a series of pockets or receptacles for receiving product. The product is inserted into each receptacle and the open end of the receptacles are sealed with a cover sheet, such as for example, aluminum foil. The blister pack may be placed inside a carton or other packaging. When a user desires to dispense one or more of the products, the product is forced through the cover sheet or the sheet is peeled back, thereby exposing the product in the receptacle. The user can then place the blister pack back into the carton or packaging.

U.S. Pat. No. 6,929,004 to Bonney et al. shows a medicine carrier formed from a single sheet having a first portion and a second portion. The first portion of the carrier includes a retainer or receptacle that holds product. The sheet is folded to form the second portion so that it covers the retainer and product. A seal joins the folded sheet thereby sealing the receptacle.

U.S. Pat. No. 5,339,960 to Price shows a blister package in which the receptacles on the blister sheet are covered by a foil barrier layer and a paper layer. Score lines are provided in the paper layer, creating a breakaway tab. The tab extends from the edge of the blister pack to an inward position over the receptacle. Removal of the tab exposes the barrier layer and permits removal of a portion of the barrier or the forcing of the article through the foil. In removing the paper tab, at least a portion of the barrier layer may be separated to create a tab for ease of further removal.

U.S. Pat. No. 5,727,687 to Renner shows a package for pellets including an elongated tray having a groove formed therein for receipt of pellets. An adhesive foil and a cover foil enclose the groove and the pellets. A flap in the cover foil is dimensioned to allow a pellet to be extracted. To dispense, a user holds the edge of the package and pulls it back, thereby opening the flap and exposing one or more pellets. After one or more pellets are extracted, the edge can be moved back to the closed position, with the flap reclosing the groove.

SUMMARY OF THE INVENTION

The present invention is a package for storing and dispensing individual products. The package includes a sleeve having an inside wall and an opening forming a slot. The package further includes a tray, which is so dimensioned to be positioned within the slot. The tray includes a flange and a plurality of receptacle cups formed within the tray and surrounded by the flange. Each cup is dimensioned to hold one or more products. A membrane is sealed to the flange of the tray, which closes the top of the cups. The membrane includes a leading edge extending from the tray and attached to the inside wall of the sleeve. The leading edge causes the membrane to peel from the flange when the tray is moved out of the sleeve. The peeling membrane uncovers one or more cups, thereby exposing one or more products for dispensing.

BRIEF DESCRIPTION OF THE DRAWINGS

For the purpose of illustrating the invention, the drawings show forms of the invention that are presently preferred. However, it should be understood that the invention is not limited to the precise arguments and instrumentalities shown in the drawings.

DETAILED DESCRIPTION OF THE DRAWINGS

Figure 1:
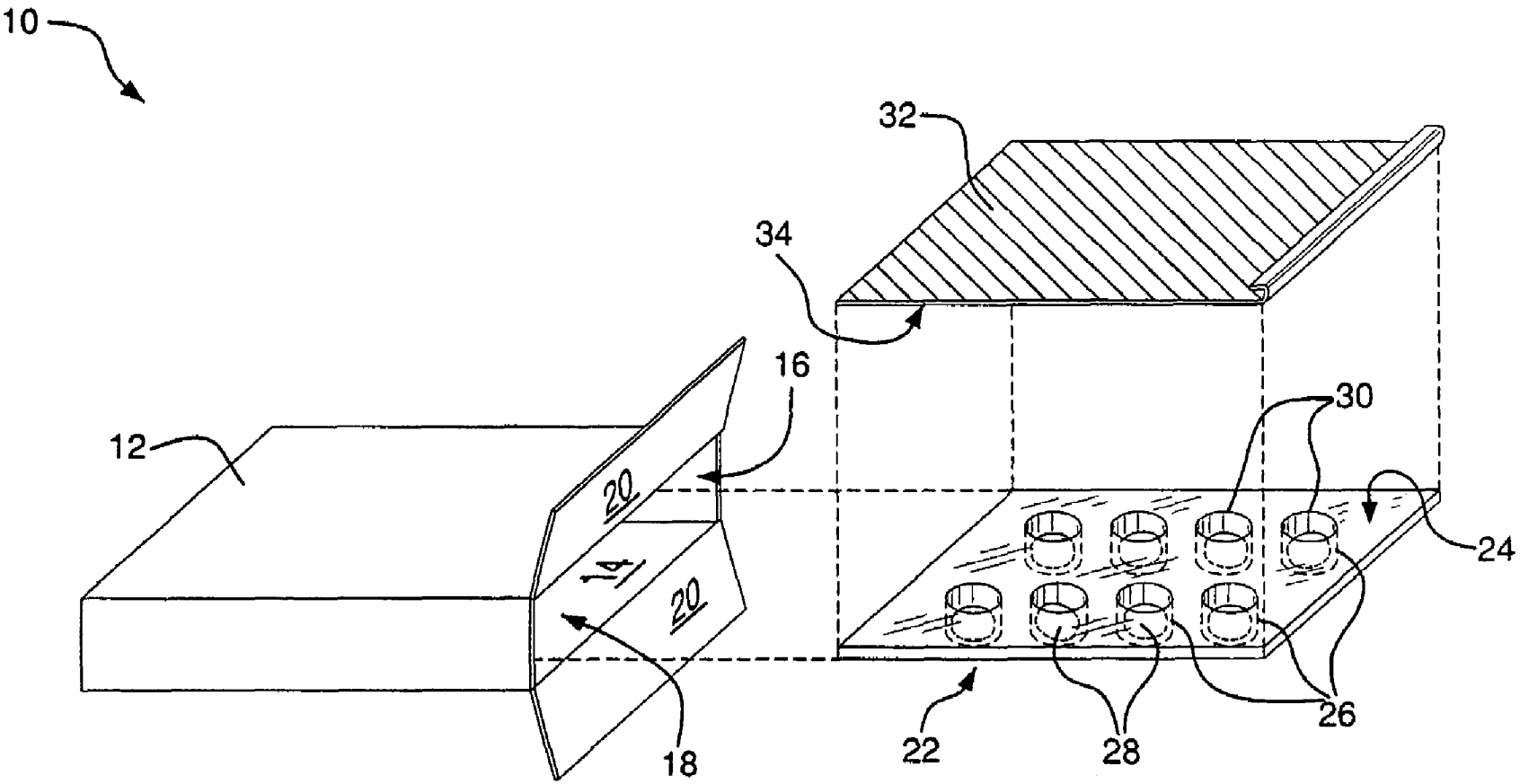
FIG. 1 is an exploded view of an embodiment of a package according to the present invention.

Referring now to the drawings wherein like numericals indicate like elements, there is shown an exemplary embodiment of a package according to the present invention. The package is generally referred to by the numeral 10. The package 10 is contemplated to be used for dispensing gum, candy, pharmaceuticals or the like. However, the package 10 may also be used to store any product in tablet form or otherwise.

Referring to FIG. 1, the package 10 includes a sleeve 12, which has an inside wall 14 and an opening 16 forming a dispensing slot 18. The sleeve 12 serves as a carton to encompass all or a portion of a tray 22 for storing product 28. The sleeve 12 can be made from any suitable material, for example, cardboard, plastic, polymer, or the like. The sleeve 12 may include resealable flaps 20 to allow the carton to be opened and closed as desired.

The tray 22 is dimensioned to move through the slot 18 from the interior of the sleeve 12. The tray 22 includes a flange 24 and a plurality of receptacle cups 26 formed therein and surrounded by the flange 24. Each cup 26 is so dimensioned to hold one or more products 28. Each cup 26 further includes an open top 30 which allows access to the products 28. The cups 26 can be formed by any known method, such as thermoforming, and may be made from any suitable material, for example, paper, plastic or the like.

It should be noted that the plurality of cups 26 shown in FIG. 1 does not the limit the arrangement or number of cups that may be included in a tray. The locations of the plurality of cups can be changed to accommodate any amount of product to be stored within the tray. For example, smaller products can, if desired, result in the use of relatively more cups for a given size of the tray. Further, the package size can be increased to fit more products or larger products within the tray. Also, the pattern of the plurality of cups can be changed for any desired purpose.

A membrane 32 is sealed to the flange 24 of the tray 22. The membrane 32 closes the open top 30 of the cups 26 thereby sealing the products 28 within the receptacles. The membrane 32 can be sealed to the flange 24 with any known means, such as heat sealing, a pressure-sensitive adhesive, or the like.

The membrane 32 can further include a fragrant portion (not shown) disposed within a sealed portion 34 of membrane 32. For example, the fragrant portion can be included within an adhesive, if an adhesive is used to seal the membrane 32 to the flange 24. The fragrant portion releases a scent when the membrane 32 is peeled from the flange 24 (removal is discussed in detail later). The scent is preferably one that is associated with the flavor or taste of the products 28 within the package 10. The scents can include, for example, smells of fruit, bubble gum, candy, chocolate, or peanut butter. However, the scent could also be something unassociated with the product.

Figure 2:
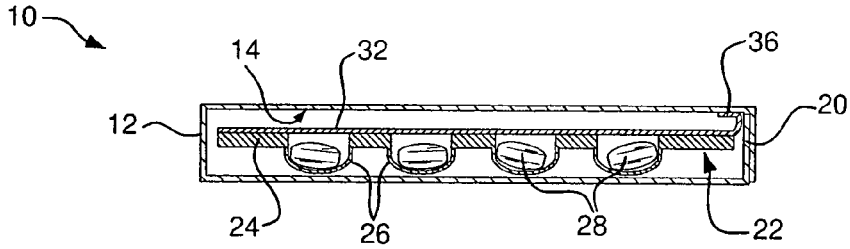
FIG. 2 is a cross sectional view of the package of FIG. 1.

Referring to FIG. 2, the package 10 is shown in a closed position. The membrane 32 includes a leading edge 36, which extends from the tray 22 and is attached to the inside wall 14 of the sleeve 12. The edge 36 can be attached by any known means, such as heat sealing, pressure-sensitive adhesive, stapling, or the like. Moreover, although FIG. 2 shows a certain distance between the top of the membrane 32 and the inside wall 14 of the sleeve 12, this space can be varied from that shown to facilitate dispensing. Likewise, the area of contact between the leading edge 36 and the inside wall 14 may also be changed depending on the material strength or the desire of the product marketer.

Figure 3:
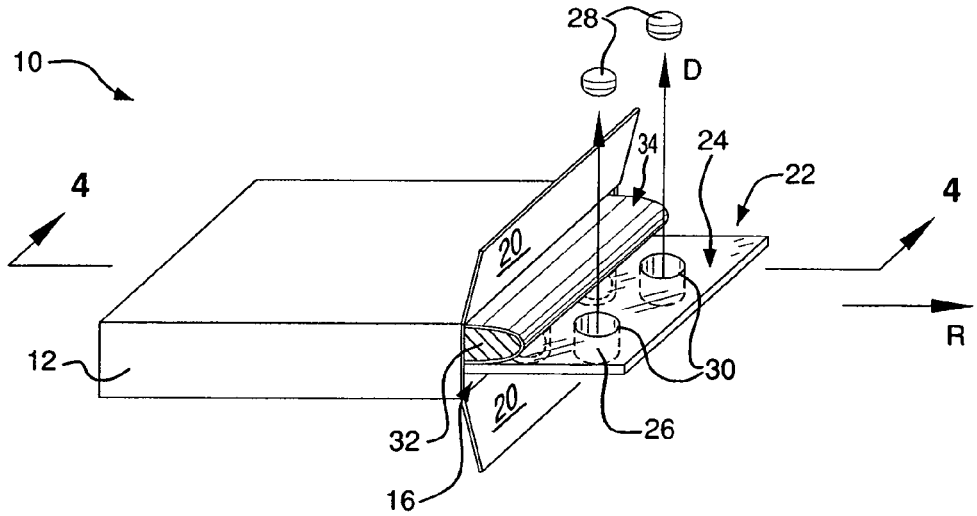
FIG. 3 is a perspective view of the package of FIGS. 1 and 2 shown in a dispensing position.
Figure 4:
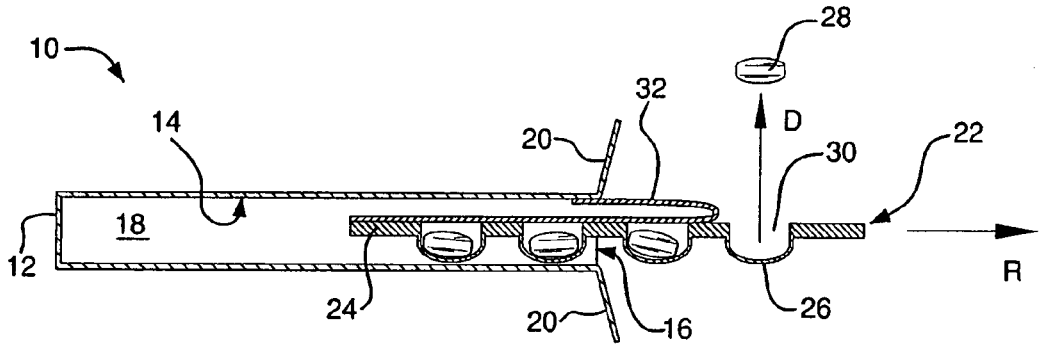
FIG. 4 is a cross sectional view of the package as taken along lines 4-4 in FIG. 3 shown in a dispensing position.

Referring to FIGS. 3 and 4, the package 10 is shown in a dispensing position. To dispense products 28, a user opens the flaps 20 of the sleeve 12 to access the tray 22. The user then pulls the tray 22 in a direction of removal R. As the tray 22 is moved out of the sleeve opening 16, the leading edge 36 of the membrane 32 remains connected to the inside wall 14. The membrane 32 peels from the flange 24 of the tray 22 as the tray 22 moves further out of the sleeve 12. When the membrane 32 is peeled a sufficient amount, the open tops 30 of the cups 26 are exposed, thereby allowing access to the product 28. The product 28 can be removed from the cups 26 in a direction of dispensing D as shown.

A user can control the number of products 28 that can be dispensed by pulling the tray 22 either a longer or shorter distance in the direction of removal R. Furthermore, as discussed above, the arrangement of the plurality of cups 26 can also alter how many products 28 are exposed for a given movement in direction R. For example, if one column of cups 26 are formed in the tray 22, only one product 28 will be dispensed with each incremental pull of the tray in the direction of the removal R. However, as shown, two columns of cups 26 allow two products 28 to be dispensed with each incremental movement.

After a user dispenses the desired amount of product 28, the tray 22 can be moved back inside sleeve 12 (opposite the direction of removal R). As the tray 22 moves back inside, the membrane 32 rolls back over the tray 22, thereby re-covering the previously exposed cups 26. This "rolling back" feature of the membrane 32 eliminates the need to dispose of pieces of membrane 32, which needed to be removed to access products 28. For example, the blister packs that require product to punch through the membrane sometimes produce small pieces of the membrane that may need to be discarded before the package can be reused. Thus, the roll-back feature provides a package 10 that improves efficiency while reducing waste.

The peeled membrane 32 may reseal with the flange 24 when the tray 22 is pushed back into the sleeve 12. Thus, products 28 that were uncovered for dispensing but not removed from the receptacles can be resealed. The resealing may serve to preserve freshness and helps to prevent spilling. The resealing the membrane 32 to the flange 24 can be accomplished by a pressure-sensitive adhesive or by a similar material.

Although the invention has been described and illustrated with respect to the exemplary embodiments thereof, it should be understood by those skilled in the art that the foregoing and various other changes, omission and additions may be made therein and thereto, without parting from the spirit and scope of the present invention.

What is claimed is:

1. A package for storing and dispensing individual products, the package comprising:

a sleeve having an inside wall and an opening forming a slot;

a tray so dimensioned to be positioned within the sleeve, the tray having a flange and a plurality of cups formed therein and surrounded by the flange, each cup having an open top and dimensioned to hold one or more products; and a membrane sealed to the flange of the tray and enclosing the open top of the cups, the membrane having a leading edge extending from the tray and attached to the inside wall of the sleeve, the attached leading edge of the membrane allowing the membrane to peel from the flange when the tray is moved out of the sleeve, opening one or more cups thereby and exposing one or more products.

2. The package of claim 1, wherein the membrane is heat sealed to the flange.

3. The package of claim 1, wherein the membrane is sealed to the flange of the tray with heat or by a pressure sensitive adhesive.

4. The package of claim 1, wherein the peeled membrane reseals with the flange to re-cover one or more cups when the tray is pushed back into the sleeve.

5. The package of claim 1, wherein the membrane further comprises fragrance portions disposed within a sealed portion.

6. A package for storing and dispensing individual products, the package comprising:

a carton having an inside wall and an opening forming a slot;

a tray positioned within the interior of the carton, the tray having a flange and a plurality of cups formed therein and surrounded by the flange, each cup having an open top and dimensioned to hold one or more products; and a membrane sealed to the flange of the tray and closing the cups, the membrane having a leading edge extending from the edge of the tray, the leading edge attached to the inside wall of the carton, the strength of attachment of the leading edge of the membrane being stronger than the sealing strength of the membrane to the flange, whereas movement of the tray in the direction of the slot causes the membrane to incrementally peel from the flange, opening one or more cups and exposing one or more products.

7. The package as claimed in claim 6, wherein the carton further comprises a flap for removeably covering the slot and closing the tray within carton.

8. The package as claimed in claim 6, wherein the membrane is sealed to the flange by a pressure sensitive adhesive.

9. The package as claimed in claim 6, wherein the membrane is resealable with the flange after the dispensing separation, upon return of the tray into the carton.

* * * * *